United States Patent [19]

Kuehler et al.

[11] 4,428,820

[45] Jan. 31, 1984

[54] COAL LIQUEFACTION PROCESS WITH CONTROLLED RECYCLE OF ETHYL ACETATE-INSOLUBLES

[75] Inventors: Christopher W. Kuehler, Larkspur; Samil Beret, Danville, both of Calif.

[73] Assignee: Chevron Research Company, San Francisco, Calif.

[21] Appl. No.: 330,521

[22] Filed: Dec. 14, 1981

[51] Int. Cl.[3] ..... C10G 1/06

[52] U.S. Cl. ..... 208/10

[58] Field of Search ..... 208/10

[56] References Cited

U.S. PATENT DOCUMENTS

| | | | |
|---|---|---|---|
| 3,852,183 | 12/1974 | Snell | 208/10 |
| 4,029,567 | 6/1977 | Farnand et al. | 208/8 |
| 4,075,080 | 2/1978 | Gorin | 208/8 |
| 4,081,360 | 3/1978 | Tan et al. | 208/8 |
| 4,102,774 | 7/1978 | Carr et al. | 208/8 |
| 4,152,244 | 5/1979 | Raichle et al. | 208/8 |
| 4,211,631 | 7/1980 | Carr et al. | 208/8 |
| 4,244,812 | 1/1981 | Baldwin et al. | 208/177 |
| 4,251,378 | 2/1981 | Simone et al. | 210/522 |
| 4,255,248 | 3/1981 | Rosenthal et al. | 208/8 |
| 4,264,429 | 4/1981 | Rosenthal et al. | 208/10 |
| 4,300,996 | 11/1981 | Kuehler | 208/10 |
| 4,330,390 | 5/1982 | Rosenthal et al. | 208/10 |

*Primary Examiner*—William G. Wright

*Attorney, Agent, or Firm*—D. A. Newell; S. R. La Paglia; S. H. Roth

[57] ABSTRACT

A process for increasing the conversion of coal to ethyl acetate-soluble products comprising:

(a) heating a slurry comprising a solvent and particulate coal in a dissolution zone to produce a first effluent slurry comprising ethyl acetate-soluble liquid components and ethyl acetate-insolubles;

(b) contacting at least a portion of said first effluent slurry with hydrogen in a reaction zone in the presence of an externally-supplied hydrogenation catalyst under hydrogenation conditions to produce a second effluent slurry which comprises ethyl acetate-soluble liquid components and ethyl acetate-insolubles, said ethyl acetate insolubles comprising organic components and inorganic components;

(c) partitioning said ethyl acetate-insolubles in at least a portion of said second effluent slurry to provide a solids-rich fraction containing ethyl acetate-insolubles enriched in inorganic components and a solids-lean fraction containing ethyl acetate insolubles enriched in organic components; and (d) recycling at least a portion of said solids-lean fraction to said dissolution zone, said recycle stream containing ethyl acetate-insolubles in an amount (1) sufficient to increase substantially the conversion of said coal to ethyl acetate-soluble components and (2) insufficient to cause the hydrogenation fouling rate of said catalyst to exceed 0.3° C. per hour.

18 Claims, 1 Drawing Figure

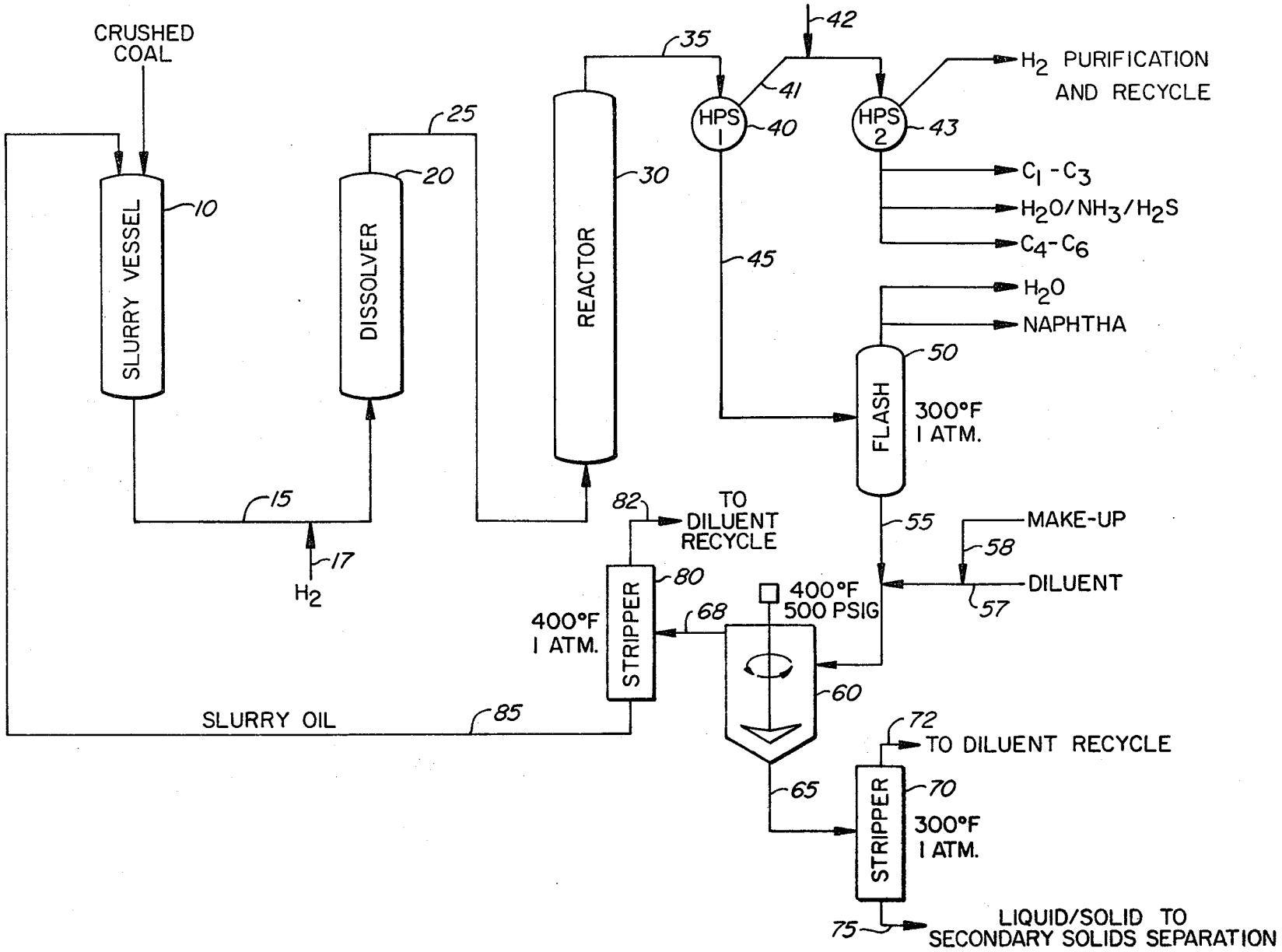
CRUSHED COAL
SLURRY VESSEL
10
15
$H_2$
17
DISSOLVER
20
25
REACTOR
30
35
HPS 1
40
41
42
HPS 2
43
45
$H_2$ PURIFICATION AND RECYCLE
$C_1$ - $C_3$
$H_2O/NH_3/H_2S$
$C_4$-$C_6$
$H_2O$
NAPHTHA
FLASH
50
300°F
1 ATM.
55
MAKE-UP
58
DILUENT
57
400°F
500 PSIG
60
65
TO DILUENT RECYCLE
68
STRIPPER
80
TO DILUENT RECYCLE
82
400°F
1 ATM.
SLURRY OIL
85
TO DILUENT RECYCLE
72
STRIPPER
70
300°F
1 ATM.
LIQUID/SOLID TO SECONDARY SOLIDS SEPARATION
75

COAL LIQUEFACTION PROCESS WITH CONTROLLED RECYCLE OF ETHYL ACETATE-INSOLUBLES

BACKGROUND OF THE INVENTION

This invention relates to the catalytic conversion of coal to produce valuable coal-derived liquids and in particular, to a method for enhancing the conversion of coal to ethyl acetate-soluble components.

A wide variety of processes have been proposed in the prior art for conversion of coal to liquid products. It is recognized that asphaltenes can be detrimental to heterogeneous catalysts employed in catalytic coal liquefaction processes. See, for example, U.S. Pat. No. 4,152,244 to Raichle et al. which discloses a process wherein asphaltenes are removed from a dissolved coal product prior to catalytic hydrocracking. Another approach is described in U.S. Pat. No. 4,081,360 to Tan et al. wherein solvent properties are controlled to suppress the formation of asphaltenes during coal liquefaction.

It is recognized that mineral matter in coal can function catalytically in the coal liquefaction process and a process employing minerals recycle is disclosed in U.S. Pat. No. 4,211,631 to Carr et al. A number of workers have employed antisolvents to facilitate solids separation in coal liquefaction processes; see, for example, U.S. Pat. No. 3,852,183 to Snell and U.S. Pat. No. 4,075,080 to Gorin. Other coal liquefaction processes which employ organic materials to aid in solids separation include those disclosed in U.S. Pat. Nos. 4,029,567, 4,102,744, and 4,244,812. Neither of the above processes, however, recognize the advantages of recycling a specific portion of ethyl acetate-insoluble materials.

SUMMARY OF THE INVENTION

This invention comprises a process for increasing the conversion of coal to ethyl acetate-soluble products in a coal liquefaction process. The process of this invention comprises:

(a) heating a slurry comprising a solvent and particulate coal in a dissolution zone to produce a first effluent slurry comprising ethyl acetate-soluble liquid components and ethyl acetate-insolubles;

(b) contacting at least a portion of said first effluent slurry with hydrogen in a reaction zone in the presence of an externally-supplied hydrogenation catalyst under hydrogenation conditions to produce a second effluent slurry which comprises ethyl acetate-soluble liquid components and ethyl acetate-insolubles, said ethyl acetate insolubles comprising organic components and inorganic components;

(c) partitioning said ethyl acetate-insolubles in at least a portion of said second effluent slurry to provide a solids-rich fraction containing ethyl acetate-insolubles enriched in inorganic components and a solids-lean fraction containing ethyl acetate insolubles enriched in organic components; and (d) recycling at least a portion of said solids-lean fraction to said dissolution zone, said recycle stream containing ethyl acetate-insolubles in an amount (1) sufficient to increase substantially the conversion of said coal to ethyl acetate-soluble components and (2) insufficient to cause the hydrogenation fouling rate of said catalyst to exceed 0.3° C. per hour.

Preferably, the recycle stream contains about 1% to 4% by weight ethyl acetate-insolubles and 2% to 10% by weight n-heptane-insolubles. The partitioning step preferably comprises the use of a diluent solvent containing both paraffinic and aromatic components. The process is particularly effective for conversion of low-rank coals, such as sub-bituminous coals.

BRIEF DESCRIPTION OF THE DRAWING

The single FIGURE of drawing is a schematic flow chart showing a technique of carrying out the process of this invention employing a process-generated solvent in the partitioning step.

DEFINITIONS

For purposes of this invention, the following definitions are used:

"Ethyl acetate-insolubles" refers to materials essentially insoluble in ethyl acetate at 25° C. and atmospheric pressure, and will hereinafter be also referred to as "EtAc-insolubles."

"N-heptane-insolubles" defines materials essentially insoluble in normal heptane at 25° C. and one atmospheric pressure and will hereinafter be also referred to as "$C_7$-insolubles" or "$C_7$-insoluble asphaltenes".

"EtAc-insolubles enriched in organic components" refers to EtAc-insoluble materials which have a higher weight ratio of organic to inorganic components than the organic/inorganic ratio of the original non-enriched EtAc-insoluble mixture in the product. By the same token, "EtAc-insoluble enriched in inorganic components" refers to EtAc-insoluble materials with higher inorganic/organic ratio than the non-enriched EtAc-insoluble mixture in the product.

The phrases "normally liquid" or "normally gaseous" refer to the state of the materials at one atmosphere pressure and 25° C.

"Aromatic components" refers to components having at least one aromatic ring.

"Naphthenic components" refers to components which are not aromatic and which have at least one saturated ring.

"Paraffinic components" refers to saturated compounds which contain no ring structures.

DETAILED DESCRIPTION OF THE INVENTION

It has been recognized that the operating life of coal liquefaction catalysts is adversely affected by high levels of $C_7$-insoluble asphaltenes. It would be desirable, however, to convert as many $C_7$-insolubles as possible to more valuable liquids, within the constraints of the catalyst system. It has been found according to this invention that a significant amount of $C_7$-insolubles, which includes EtAc-insolubles, can be recycled in a catalytic coal liquefaction process without causing intolerable catalyst fouling, and can thereby result in an increased yield of net liquid products. According to this invention, the liquid yield of the process is defined as the yield of ethyl acetate-soluble materials.

Generally, coal liquefaction components which are insoluble in ethyl acetate are also insoluble in n-heptane. According to this invention, it has been found that a portion of the EtAc-insolubles can be recycled. In addition, a portion of the $C_7$-insolubles which are EtAc-solubles can also be recycled. Recycling these components can result in significant increases in conversion of coal to EtAc-solubles without intolerable catalyst fouling. By recycling a portion of the EtAc-insolubles to the liquefaction process rather than removing them prior to the catalytic step, the catalyst has an opportunity to perform incremental conversion into more valuable liquid products.

The portion of EtAc-insolubles which is recycled is the product of a partitioning step in which the EtAc-insolubles exiting the catalytic reactor are partitioned into at least two portions, including a portion enriched in organic components and a portion enriched in inorganic components, i.e., depleted in organic components. Only the organic-enriched portion of the EtAc-insolubles is recycled. Typically, the recycled liquid will also contain about 2% to 10% by weight $C_7$-insolubles, e.g., 4–8% $C_7$-insolubles.

The primary coal liquefaction process of the present invention is carried out in at least two separate and distinct reaction stages. The coal is substantially dissolved in a high temperature first stage by heating a slurry comprising a solvent (i.e., a slurry vehicle) and particulate coal in a dissolution zone in the presence of hydrogen to substantially dissolve the coal, e.g., at least about 50% dissolution of the coal on a moisture- and ash-free basis. The effluent slurry from the dissolution step is composed of a normally liquid portion comprising ethyl acetate-soluble liquids, as well as light gases ($H_2$, $C_4$—, $H_2O$, $NH_3$, $H_2S$, etc.) and undissolved solids. The undissolved solids comprise EtAc-insolubles and include undissolved coal and ash particles. The normally liquid portion comprises solvent and dissolved coal and contains nondistillable components. The term "solvent" also includes solvent materials which have been converted in the dissolution stage. At least a portion, preferably all, of the normally liquid portion containing undissolved solids, (optionally along with the gaseous components) is passed to a second reaction zone wherein it is reacted with hydrogen in the presence of an externally-supplied hydrogenation catalyst under hydrogenation conditions. These hydrogenation conditions preferably include a temperature lower than the temperature to which the slurry is heated in the first stage. If desired, the normally liquid effluent from the first stage can be treated in an intermediate step prior to passage to the second hydrogenation zone of this invention. The intermediate step can be treatment in a catalytic or noncatalytic reactor, a guard bed reactor, etc. Such intermediate steps are described in commonly assigned, co-pending U.S. patent application Ser. No. 106,580, filed Dec. 26, 1979, entitled "Three-Stage Coal Liquefaction Process", in commonly assigned U.S. Pat. No. 4,264,430, issued Apr. 28, 1981 for "Three-Stage Coal Liquefaction Process" and in commonly assigned U.S. Pat. No. 4,283,268, issued Aug. 11, 1981 for "Two-Stage Coal Liquefaction Process With Interstage Guard Bed," the disclosures of which are incorporated herein by reference.

According to this invention at least a portion of the normally liquid product of the first reaction zone, with or without intermediate treatment, and most preferably containing undissolved solids, is contacted with hydrogen and a catalyst in the second zone, most preferably operated at a lower temperature. At least some or all of the undissolved solids can be removed between stages, but such interstage solids removal is not recommended because of the high viscosity of the liquid portion and because it would likely result in reduced yield. Preferably, the second hydrogenation zone contains a bed of hydrogenation catalyst particles which are preferably in the form of catalytic hydrogenation components supported on an inorganic refractory porous support. The hydrogenation catalyst can be present as a fixed bed, a packed bed which can be a continuously or periodically moving, or an ebullating bed. Preferably, the feed to the second reaction zone is passed upwardly through the catalyst bed.

FEEDSTOCKS

The basic feedstock to the process of this invention is coal, e.g., bituminous coal, subbituminous coal, brown coal, lignite, peat, etc. The coal should preferably be ground finely to provide adequate surface for dissolution. Preferably, the particle sizes of coal should be smaller than $\frac{1}{4}$ inch in diameter and most preferably smaller than 100 mesh (Tyler sieve size) and finer; however, larger sizes can be utilized. The coal can be added as a dry solid or as a slurry. If desirable, the coal can be ground in the presence of a slurrying oil. The process of this invention is particularly advantageous for the liquefaction of low-rank coals such as subbituminous coal, lignite, brown coal, etc.

DISSOLUTION SOLVENT

The solvent materials, i.e. slurry vehicles, useful in the process of this invention are obtained at least in part from the process effluent of the second stage hydrogenation zone by separating the inorganic-rich portion of the EtAc-insolubles from the normally liquid portion of the second stage effluent. This provides a carbonaceous liquid recycle stream, which contains EtAc-insolubles enriched in organic components.

A portion of the slurry vehicle may also include other materials such as crude petroleum or petroleum-derived materials such as petroleum residua, tars, asphaltic petroleum fractions, topped crudes, tars from solvent components preferably contain only components boiling above about 200° C. When crude petroleum or petroleum-derived liquids which contain soluble metals contaminants such as nickel, vanadium and iron, are employed as solvent components, soluble metals are deposited on particles of unreacted coal or coal ash. In addition, coking of the slurry vehicle is reduced by the presence of the coal solids.

DISSOLVING ZONE (FIRST STAGE)

Particulate coal can be mixed with solvent, preferably in a solvent:coal weight ratio from about 1:2 to 4:1, more preferably from about 1:1 to 2:1. With reference to the FIGURE, the mixing can occur in slurry vessel 10 where the slurry is fed through line 15 to dissolver 20. In the dissolving zone 20, the slurry is heated to a temperature preferably in the range of about 400° C. to 480° C., more preferably 425° C. to 450° C., and most preferably 435° C. to 450° C. for a length of time sufficient to substantially dissolve the coal. At least about 50% by weight, and more preferably greater than 70% by weight, and still more preferably greater than 90% by weight of the coal on a moisture- and ash-free basis is dissolved in dissolver 20, thereby forming a mixture of solvent, dissolved coal and insoluble coal solids. Hydrogen is also introduced in the dissolving zone through line 17 and can comprise fresh hydrogen and/or recycled gas. Carbon monoxide can be present in either reaction zone if desired but preferably the gas feed to both reaction zones is free of added carbon monoxide. Reaction conditions in the dissolver can vary widely in order to obtain at least 50% dissolution of coal solids. Normally, the slurry should be heated to at least about 400° C. in order to obtain at least 50% dissolution of coal in a reasonable time. Further, the coal should not be heated to temperatures much above 480° C. since this results in thermal cracking which would substantially reduce the yield of normally liquid products. Other reaction conditions in the dissolving zone include a residence time of 0.1 to 3 hours, preferably 0.1 to 1.0 hour; a pressure in the range of 70 to 700 atmospheres, preferably 100 to 350 atmospheres, and more preferably 100 to 170 atmospheres; and a hydrogen gas rate of 170 to 3500 cubic meters per cubic meter of slurry, and preferably 500 to 1740 cubic meters per cubic meter of slurry. It is preferred that the hydrogen pressure in the dissolving zone be maintained above 35 atmospheres. The feed may flow upwardly or downwardly in the dissolving zone, preferably upwardly. Preferably, the dissolving zone is elongated sufficiently so that plug flow conditions are approached. A suitable flow distributor for introducing the feed into the dissolving zone is described in commonly assigned U.S. patent application Ser. No. 160,793, filed June 19, 1980 and entitled "Gas Pocket Distributor For An Upflow Reactor," which is incorporated herein by reference. The dissolving zone can be operated with no catalyst or contact particles from any external source, although the mineral matter contained in the coal may have some catalytic effect. It has been found, however, that the presence of a dispersed dissolution catalyst can result in the increased production of lighter liquid products and in some cases can increase the overall coal conversion in the process. It is preferred, however, that the first stage dissolver contain no nominally noncatalytic contact particles such as alumina, silica, etc. "Nominally noncatalytic particles" are particles which do not contain externally-supplied transition metals as hydrogenation components.

The dissolution catalyst, if employed, can be any of the well known materials available in the prior art, and contains an active catalytic component in elemental or compound form. Examples include finely divided particles, salts, or other compounds of tin, lead, or the transition elements, particularly Groups IV-B, V-B, VI-B or Group VIII of the Periodic Table of the Elements, as shown in *Handbook of Chemistry and Physics,* 45th Edition, Chemical Rubber Company, 1964. For purposes of this disclosure the dissolution catalyst composition is defined as the composition of the catalytic material added to the process, regardless of the form of the catalytic elements in solution or suspension.

The dispersed dissolution catalyst can be dissolved or otherwise suspended in the liquid phase, e.g. as fine particles, emulsified droplets, etc., and is entrained from the first stage in the liquid effluent. The dispersed catalyst can be added to the coal before contact with the solvent, it can be added to the solvent before contact with the coal, or it can be added to the coal-solvent slurry. A particularly satisfactory method of adding the dispersed catalyst is in the form oil/aqueous solution emulsion of a water-soluble compound of the catalyst hydrogenation component. The use of such emulsion catalysts for coal liquefaction is described in U.S. Pat. No. 4,136,013 to Moll et al. for "Emulsion Catalyst for Hydrogenation Processes" Jan. 23, 1979, the disclosure of which is incorporated herein by reference. The water soluble salt of the catalytic metal can be essentially any water soluble salt of metal catalysts such as those of the iron group, tin or zinc. The nitrate or acetate may be the most convenient form of some metals. For molybdenum, tungsten or vanadium, a complex salt such as an alkali metal or ammonium molybdate, tungstate, or vanadate may be preferable. Mixtures of two or more metal salts can also be used. Particular salts are ammonium heptamolybdate tetrahydrate [$(NH_4)_6Mo_7O_{24}.4H_2O$], nickel dinitrate hexahydrate [$Ni(NO_3)_2.6H_2O$], and sodium tungstate dihydrate [$NaWO_4.2H_2O$]. Any convenient method can be used to emulsify the salt solution in the hydrocarbon medium. A particular method of forming the aqueous-oil emulsion is described in the above-mentioned U.S. Pat. No. 4,136,013.

If dissolution catalysts are added as finely divided solids they can be added as particulate metals, their oxides, sulfides, etc., e.g., $FeS_x$; waste fines from metal refining processes, e.g., iron, molybdenum, and nickel; crushed spent catalysts, e.g., spent fluid catalytic cracking fines, hydroprocessing fines, recovered coal ash, and solid coal liquefaction residues. It is contemplated that the finely divided dissolution catalyst added to the first stage will generally be an unsupported catalyst; that is, it need not be supported on inorganic carriers such as silica, alumina, magnesia, etc. However, inexpensive waste catalyst fines containing catalytic metals may be used, if desired.

The dispersed dissolution catalyst can also be an oil-soluble compound containing a catalytic metal, for example, phosphomolybdic acid, naphthenates of molybdenum, chromium, and vanadium, etc. Suitable oil-soluble compounds can be converted to dissolution catalysts in situ. Such catalysts and their utilization are described in U.S. Pat. No. 4,077,867 for "Hydroconversion of Coal in a Hydrogen Donor Solent with an Oil-Soluble Catalyst" issued Mar. 7, 1978, the disclosure of which is incorporated by reference.

HYDROGENATION ZONE (SECOND STAGE)

The dissolution zone effluent contains normally gaseous, normally liquid, and undissolved solid components including undissolved coal, coal ash, and in some cases particles of dispersed catalysts. The entire effluent from the first stage zone can be passed directly to the second stage hydrogenation zone 30. Optionally, light gases, e.g., $C_4$—, water, $NH_3$, $H_2S$, etc., can be removed from the product of the first stage before passage of preferably the entire normally liquid effluent and the solids fraction to the second stage. Feed to the second stage shoul contain at least a major portion (more than 50% by weight) of the normally liquid product of the first stage as well as the undissolved coal solids and dispersed hydrogenation catalyst, if any. The liquid feed to the second stage should at least contain the heaviest liquid portion of the first stage liquid product, e.g., 200° C.+ or 350° C.+ fractions, which contain non-distillable components. In the second stage hydrogenation zone, the liquid-solids feed is contacted with hydrogen. The hydrogen may be present in the effluent from the first stage or may be added as supplemental hydrogen or recycle hydrogen. The second stage reaction zone contains the second hydrogenation catalyst which is normally different from the dissolution catalysts which may be employed in the first stage. The second stage hydrogenation catalyst is preferably one of the commercially available supported hydrogenation catalysts, e.g., a commercial hydrotreating or hydrocracking catalyst. Suitable catalysts for the second stage preferably comprise a hydrogenation component and a cracking component. Preferably, the hydrogenation component is supported on a refractory cracking base, most preferably a weakly acidic cracking base such as alumina.

Other suitable cracking bases include, for example, two or more refractory oxides such as silica-alumina, silica-magnesia, silica-zirconia, alumina-boria, silica-titania, clays, and acid-treated clays such as attapulgite, sepiolite, halloysite, chrysotile, palygorskite, kaolinite, imogolite, etc. Suitable hydrogenation components are preferably selected from Group VI-B metals, Group VIII metals, or their oxides, sulfides, and mixtures thereof. Particularly useful combinations are cobalt-molybdenum, nickel-molybdenum, or nickel-tungsten, on alumina supports. A preferred catalyst is comprised of an alumina matrix containing about 8% nickel, 20% molybdenum, 6% titanium, and 2% to 8% phosphorus, such as can be prepared using the general cogellation procedures described in U.S. Pat. No. 3,401,125 to Jaffe, Sept. 10, 1968, for "Coprecipitation Method For Making Multi-Component Catalyst," which is incorporated herein by reference, wherein phosphoric acid is employed as a phorphorus source.

It is important in the process of the present invention that the temperatures in the second stage hydrogenation zone are not too high because it has been found that second stage catalysts rapidly foul at high temperatures. This is particularly important when fixed or packed beds are employed which do not permit frequent catalyst replacement. The temperatures in the second hydrogenation zone should normally be maintained below about 425° C., preferably in the range above 310° C., and more preferably 340° C. to 400° C.; however, higher end-of-run temperatures may be tolerable in some cases. Generally, the temperature in the second hydrogenation zone will always be at least about 15° C. below the temperature in the first hydrogenation zone and preferably 55° C. to 85° C. lower. Other typical hydrogenation conditions in the second hydrogenation zone include a pressure of 70 to 700 atmospheres, preferably 70 to 200 atmospheres, and more preferably 100 to 170 atmospheres; hydrogen rates of 350 to 3500 cubic meters per cubic meter of slurry, preferably 500 to 1740 cubic meters per cubic meter of slurry; and a slurry hourly space velocity in the range of 0.1 to 2, preferably 0.1 to 0.5 hours$^{-1}$. The pressure in the catalytic hydrogenation zone can be essentially the same as the pressure in the dissolution zone, if desired.

The catalytic hydrogenation zone is preferably operated as an upflow packed or fixed bed; however, an ebullating bed may be used. The packed bed may move continuously or intermittently, preferably countercurrently to the slurry feed, in order to permit periodic, incremental catalyst replacement. It may be desirable to remove light gases generated in the first stage and to replenish the feed in the second stage with hydrogen. Thus, a higher hydrogen partial pressure will tend to increase catalyst life.

When a fixed or packed bed is employed in the second hydrogenation stage, it is preferred that the severity of the second stage be limited to avoid undesirable asphaltene precipitation which leads to undue plugging and pressure drops. This method of operation is described in commonly assigned U.S. patent application Ser. No. 278,976, filed June 29, 1981, for "Hydroprocessing Carbonaceous Feedstocks Containing Asphaltenes," incorporated herein by reference. The feed into the second stage is preferably fed through a distributor system as disclosed in the above-mentioned, commonly assigned U.S. patent application Ser. No. 160,793.

DOWNSTREAM PROCESSING

The product effluent 35 from hydrogenation zone 30 is separated in a first high pressure separator 40 into a gaseous fraction 41 and a liquid-solids fraction 45. The gaseous fraction 41 is passed to second high pressure separator 43 where it is separated into a hydrogen stream, a $C_1$–$C_3$ stream, an $H_2O/NH_3/H_2S$ stream, and a $C_4$–$C_6$ naphtha stream. A scrubbing solvent can be added through line 42, if desired. Preferably, the $H_2$ is separated from other gaseous components and recycled to the second stage hydrogenation or the first stage dissolving stages as desired. A liquid-solids fraction 45 is passed to flash zone 50 where a gas stream containing $H_2O$ and naphtha is recovered and liquid-solids fraction 55 is passed on to further separation. Flash zone 50 can be an atmospheric flash zone operated at 90° C. to 400° C., for example, 150° C. If desired, correspondingly higher boiling bottoms can be obtained by operating zone 50 under vacuum. Liquid-solids fraction 55 from flash zone 50 will contain substantially all the components boiling above the operating temperature of flash zone 50 including substantially all of the EtAc-insolubles. Liquid-solids fraction 55 is then passed to a solids partitioning zone.

SOLIDS PARTITIONING ZONE

EtAc-insolubles which are present in the liquid-solids stream from the second stage reactor contain both organic and inorganic components. The inorganic components are typically the ash fraction of the coal. The organic components comprise condensed polyaromatics and other refractory organic solids which also will contain inorganic components. The function of the solids partitioning zone is to partially separate the EtAc-insolubles. This is accomplished by separating the liquid-solid fraction, or a portion thereof, into at least two fractions: a solids-rich fraction containing EtAc-insolubles which are enriched in inorganic components and a solids-lean fraction containing EtAc-insolubles which are enriched in organic components. The solids-lean fraction is recycled to the dissolution zone for further conversion to EtAc-soluble components. It is anticipated that organic-rich EtAc-insolubles could be recycled elsewhere in the process; however, the recycle to the dissolving step will provide the greatest exposure to hydrogenation conditions and thereby would result in the greatest conversion to EtAc-soluble materials. The EtAc-insolubles partitioning step may involve treatment with a selective solvent which is effective for partitioning the EtAc-insolubles as hereinafter described. Alternately or concurrently, the partitioning step can also include a controlled cooling step wherein the partition is effected by selective precipitation of inorganic-rich EtAc-insolubles. It is expected that other techniques for efficient partitioning can be devised for use according to this invention. It is contemplated that the partitioning step will also include a solids separation step such as a filter, a settler, a hydroclone, or a centrifuge and that the inorgaic-rich EtAc-insolubles will be concentrated in the solids-rich phase.

The FIGURE depicts a particularly preferred partitioning system which comprises selective solvent or diluent addition followed by settling to produce a solids-lean slurry oil enriched in organic EtAc-insolubles. To liquid-solids stream 55 is added a selective solvent through line 57. The solvent is recycled through the process as hereinafter described and make-up diluent is added as needed through line 58. The diluted liquid-solids fraction is pressurized and heated to the conditions for settler 60. The settler can operate, for example, at atmospheric pressure and at a temperature, from about 35° C. up to about 120° C. or at elevated pressure with temperatures substantially higher, up to about 300° C. Preferred operating conditions for the settler are a pressure of 1 to 70 atmospheres, preferably 35 atmospheres, and a temperature of 150° C. to 300° C., preferably 200° C. The diluent can be added in any proportion, preferably in a volume ratio of 10:1 to 1:10, e.g., 1:1 relative to the solids-liquid fraction 55. The diluent is essentially miscible with the liquid phase. The contents of settler 60 separate into a solids-lean upper phase and a solids-rich lower phase. The organic EtAc-insolubles preferentially distribute to the upper phase and the inorganic EtAc-insolubles preferentially distribute to the lower phase. The lower phase is removed through line 65 to stripper 70 for diluent recovery. Stripper 70 is preferably operated at substantially the same temperature and pressure as flash 50 and the diluent is thereby recovered for recycle through line 57. The underflow from stripper 70 is the net heavy liquid product, including solids, which will pass to further solids separation such as hydrocloning, settling, filtration, etc., to provide a liquefied coal product substantially free of solids. Alternately, the diluent can be recovered after the final solids separation. The overflow from settler 60 is passed through line 68 to stripper 80 which is an atmospheric stripper which can be operated at the same or a higher temperature than flash 50, preferably 150° to 300° C., most preferably 200° C. The top fraction is recycled through line 82 to line 57 for use as diluent. The bottoms fraction from stripper 80 contains distillable and non-distillable components and is a solvent recycle slurry oil containing EtAc-insolubles which are enriched in organic components. This bottoms fraction is recycled to the slurry vessel through line 85. The slurry oil recycled contains 0.5% to 5%, preferably about 1% to 4% by weight total EtAc-insolubles and will generally also contain more than 0.5%, generally about 2% to 10% by weight total $C_7$-insolubles. If desired, some of the bottoms from stripper 80 can make up at least a portion of the net liquid product.

The maximum permissible amounts of EtAc-insolubles and $C_7$-insolubles in the slurry oil are related to the properties of the catalyst in reactor 30. Catalysts which which are particularly tolerable of $C_7$-insolubles can tolerate greater amounts of EtAc-insolubles and $C_7$-insolubles in the slurry oil. Generally, the total $C_7$-insolubles and EtAc-insolubles in the slurry oil should be no higher than that which will result in a catalyst fouling rate for hydrogenation of no greater than 0.3° C. per hour; that is, the catalytic reactor temperature need be increased no more than 0.3° C. per hour in order to maintain a constant hydrogen/carbon atomic ratio in the total product. Much lower catalyst fouling rates can be obtained according to this invention; for example, less than 0.05° C. per hour, and even as low as in the order of 0.005° C. per hour. It is most desirable that the catalyst fouling rate be maintained below 0.05° C. per hour.

The selective diluent can be obtained from the process. The boiling range of the diluent will be determined by the conditions in flash 50 and stripper 80, taking into account incomplete separations due to short residence time, etc. The selective diluent, a solvent, should contain both aromatic and paraffinic components. For example, it should contain at least about 2% aromatics, preferably 5% to 50% by weight, at least 10% paraffins, preferably about 30% to 40% by weight. Naphthenic components can optionally be present, with optional moderate amounts of olefins, etc. The maximum permissible level of aromatics in the selective diluent depends upon the catalyst in the second stage. The more aromatic the diluent, the higher the concentration of $C_7$-insolubles recycled to the process. The particularly preferred selective diluent contains 30% to 40% paraffins, 40% to 50% naphthenes, and 5% to 15% aromatics, by weight. Generally, the selective solvent will contain at least about 75% by weight components boiling below 200° C. A typical boiling range will be about 50% boiling below 100° C., 30% boiling from 100° C. to 125° C., 15% boiling from 125° to 200° C., and 5% boiling above 200° C. Such a solvent composition can generally be maintained by operating the system shown in the FIGURE with flash 50 operating at 150° C. and one atmosphere, stripper 70 operating at 150° C. and one atmosphere, and stripper 80 operating at 200° C. and one atmosphere. Make-up solvent is added as needed through line 58 to compensate for separation inefficiencies. A suitable make-up solvent is "250 Thinner," available from Chevron U.S.A. Inc., Richmond, Calif.

When such process-derived solvents containing aromatic components are used as diluent, the solids exiting the settling step in the overhead are typically about 10% inorganic and 90% organic in composition. After organic EtAc-insolubles are preferentially extracted into the liquid phase, the undissolved solids exiting the settling step are typically about 60% inorganic and 40% organic. At least a portion of the organic-rich EtAc-insolubles may be liquids at the settler conditions employed.

Table 1 depicts the results of comparable two-stage coal liquefaction runs of Decker subbituminous coal. Each reactor employed the same catalyst and the entire dissolver product was passed to the reactor. In runs 1, 2, and 3 different diluents were used to precipitate $C_7$-insolubles. In Run 1, the diluent was 250 Thinner, which is a mixture of about 50% paraffins and 50% naphthenes in the $C_6$–$C_{10}$ range. In Run 2, the diluent was a process-derived diluent having a boiling range of about 50%, less than 100° C., 30% boiling from 100° C. to 125° C., 15% boiling from 125° to 200° C. and 5% boiling above 200° C. derived by operating the process according to the FIGURE. In Run 3, the diluent was toluene. The diluent/catalyst in each case was a nickel-molybdenum-titanium-phosphorus catalyst on an alumina support having a composition as described hereinabove. The settler in runs 1, 2, and 3 was operated under essentially the same conditions, within its control constraints.

TABLE 1

| Run Number | 1 | 2 | 3 |
|---|---|---|---|
| Dissolver | | | |
| Temp. (°C.) | 440 | 440 | 440 |
| Space Velocity ($hr^{-1}$) | 2 | 1 | 1 |
| Pressure (atm.) | 160 | 160 | 160 |
| $H_2$ Rate ($m^3/m^3$) | 1,740 | 1,740 | 1,740 |
| Catalytic Reactor | | | |
| Temp. (°C.) | 355 | 360 | 360 |
| Space Velocity ($hr^{-1}$) | 0.33 | 0.33 | 0.33 |
| Pressure (atm.) | 160 | 160 | 160 |

TABLE 1-continued

| Run Number | 1 | 2 | 3 |
|---|---|---|---|
| Diluent | 250 Thinner | Process-Derived | Toluene |
| EtAc-Insolubles In Recycle Solvent (wt. %) | 0 | 1 | 8 |
| Total $C_7$-Insolubles In Recycle Solvent (wt. %) | 1.3 | 4.5 | 13.5 |
| Catalyst Fouling Rate (°C./hr) | 0.0056 | .0083 | 0.078 |
| Coal Conversion (MAF) to EtAc-Solubles | 69.6% | 85.8% | 90.9% |

In Run 1, where the diluent contained essentially no aromatic components, the recycle contained essentially no EtAc-insolubles and only about 1.3% total $C_7$-insolubles. While the catalyst fouling rate in Run 1 was very low (0.0056° C./hour); the coal conversion was only about 70%.

In Run 2, the diluent was a process-derived diluent containing both aromatic and paraffinic components, and was employed under the same settling conditions as in Run 1. The EtAc-insolubles content of the recycle solvent was about 1%, and the total $C_7$-insolubles content was about 4.5%. Conversion was significantly higher than Run 1 at 85.8%, with a catalyst fouling rate of 0.0083° C./hour.

In Run 3, the conversion was nearly 91% when 8% by weight EtAc-insolubles were present in the recycle; however. The catalyst fouling rate was 0.078° C./hour, which is generally considered too high for reactors such as fixed bed reactors which do not permit partial catalyst replacement. Such high fouling rates may be tolerable in moving or ebullating bed reactors, for example.

Table 2 presents a comparison employing Illinois No. 6 bituminous coal. The catalyst was the same as used in Runs 1–3. The solids separation was performed in a settler operated at 200° C., and a pressure of 35 atmospheres.

TABLE 2

| Run Number | 5 | 6 |
|---|---|---|
| Dissolver | | |
| Temp. (°C.) | 446 | 446 |
| Space Velocity ($hr^{-1}$) | 2 | 2 |
| Pressure (atm.) | 160 | 160 |
| $H_2$ Rate ($m^3/m^3$) | 1,740 | 1,740 |
| Catalytic Reactor | | |
| Temp. (°C.) | 365 | 365 |
| Space Velocity ($hr^{-1}$) | 0.33 | 0.33 |
| Pressure (atm.) | 160 | 160 |
| Diluent | Process-Derived | 250 - Thinner |
| EtAc-Insolubles In Recycle Solvent (wt. %) | 2.5 | 0 |
| Total $C_7$-Insolubles In Recycle Solvent (wt. %) | 4.1 | 2.4 |
| Catalyst Fouling Rate (°C./hr) | 0.0083 | 0.0056 |
| Coal Conversion (MAF) to EtAc-Solubles | 94.3% | 92.6 |

It is seen that the incremental increase in overall coal conversion resulting from selective recycle of EtAc-insolubles is much more dramatic when low rank, e.g., subbituminous coals, are processed. Even a relatively small increase in percent conversion, however, results in millions of dollars annually in a commercial-scale operation. According to this invention, all that is necessary is that sufficient organic-rich EtAc-insolubles be recycled to the dissolver, e.g., in the slurry oil, to substantially increase conversion to EtAc-soluble products, i.e., at least 0.3 percentage points, preferably at least 0.5 percentage points, over the conversion obtained at the same conditions without the partitioning step.

It will be appreciated by those of ordinary skill in the coal processing arts that the process of this invention employing the deliberate recycle of organic-rich EtAc-insolubles can be practiced in a wide variety of embodiments including the use of partitioning steps substantially different from those specifically disclosed herein, and such embodiments are contemplated as equivalents of the invention.

We claim:

1. A process for increasing the conversion of coal to ethyl acetate-soluble products in a coal liquefaction process which comprises:

(a) heating a slurry comprising a first solvent and particulate coal in a dissolution zone to produce a first effluent slurry comprising ethyl acetate-soluble component and ethyl acetate-insolubles;

(b) contacting at least a portion of said first effluent slurry with hydrogen in a reaction zone in the presence of an externally-supplied hydrogenation catalyst under hydrogenation conditions to produce a second effluent slurry comprising ethyl acetate-soluble liquid components and ethyl acetate-insolubles which comprise organic components and inorganic components;

(c) contacting at least a portion of said second effluent with a second solvent containing at least 2 weight percent aromatic components to preferentially precipitate inorganic ethyl acetate-insoluble components, and recovering a solids-lean fraction containing ethyl acetate-insolubles enriched in organic components; and (d) recycling at least a portion of said solids-lean fraction to said dissolution zone.

2. The process according to claim 1 wherein the recycled portion of said solids-lean fraction contains ethyl acetate-insolubles in an amount;

(1) sufficient to increase substantially the conversion of said coal to ethyl acetate-soluble components; and (2) insufficient to cause the hydrogenation fouling rate of said catalyst to exceed 0.3° C. per hour.

3. The process according to claim 1 wherein the recycled portion of said solids-lean fraction contains ethyl acetate-insolubles in an amount insufficient to cause the hydrogenation fouling rate of said catalyst to exceed 0.05° C. per hour.

4. The process according to claim 1, 2, or 3 wherein said second solvent contains at least 10% by weight paraffins and from 5 to 50% by weight aromatics.

5. The process according to claim 4 wherein said second solvent comprises by weight about 30 to 40% paraffins, about 40–50% naphthenics, and about 5 to 15% aromatics, and at least 75% by weight of said second solvent has a boiling point below 200° C.

6. The process according to claim 4 wherein said precipitated inorganic ethyl acetate-insolubles are removed by gravity settling at elevated temperature and pressure.

7. The process according to claim 4 wherein said precipitated inorganic ethyl acetate-insolubles are removed by gravity settling at a temperature of 35° C. to 300° C. and a pressure of 1 to 70 atmospheres.

8. The process according to claim 4 wherein said hydrogenation catalyst comprises at least one hydrogenation component selected from Group VI-B and Group VIII supported on an alumina support.

9. The process according to claim 2 wherein said coal is low-rank coal.

10. A coal liquefaction process comprising:

(a) heating a slurry comprising a first solvent and particulate coal in a dissolution zone at a temperature of 400° to 480° C., a pressure of 70 to 700 atmospheres, a residence time of 0.1 to 3 hours, and a hydrogen rate of 170 to 3500 cubic meters per cubic meter of slurry to substantially dissolve the coal and provide a first effluent slurry having a normally liquid portion comprising solvent and dissolved coal and containing insoluble solids and liquid components boiling above 350° C.;

(b) passing at least a portion of the normally liquid portion containing insoluble solids and liquid components boiling above 350° C. upwardly through a reaction zone containing a packed bed comprising a hydrogenation catalyst under hydrogenation conditions including a temperature of 310° C. to 425° C., a pressure of 70 to 700 atmospheres, a hydrogen flow rate of 350 to 3500 cubic meters per cubic meter of slurry, and a slurry hourly space velocity of 0.1 to 2 hours to produce a second effluent slurry having a normally liquid portion and containing ethyl acetate-insolubles, said ethyl acetate-insolubles comprising organic components and inorganic components;

(c) separating the light gases in a naphtha fraction from said second effluent slurry to provide a liquid-solids effluent and contacting the liquid-solids effluent with a second solvent comprising at least 10% by weight paraffinic and at least 2% by weight aromatic components to selectively precipitate inorganic ethyl acetate-insolubles and provide a solids-lean carbonaceous liquid stream containing nondistillable liquid components and containing ethyl acetate-insolubles enriched in organic components;

and (d) recovering a second solvent fraction from said solids-lean stream and recycling at least a portion of the remainder of said solids-lean stream containing nondistillable liquid components to said dissolving step.

11. The process according to claim 10 wherein said recycled solids-lean stream contains about 0.5% to 5% by weight ethyl acetate-insolubles.

12. The process according to claim 10 wherein said recycled solids-lean stream contains about 1% to 4% by weight ethyl acetate-insolubles.

13. The process according to claim 10 wherein said recycled solids-lean stream contains about 2% to 10% by weight n-heptane-insolubles.

14. The process according to claim 10 wherein said solids-lean stream is recycled to said dissolving step without intervening hydrogenation steps.

15. The process according to claim 10 wherein said second solvent comprises by weight about 30 to 40% paraffins, about 40 to 50% naphthenics, and about 5 to 15% aromatics, and at least 75% by weight of said second solvent has a boiling point below 200° C.

16. The process according to claim 10, 11, 12, 13, 14, or 15 wherein said recycled solids-lean stream contains ethyl acetate-insolubles in an amount (1) sufficient to increase substantially the conversion of said coal to ethyl acetate-soluble components, and (2) insufficient to cause the hydrogenation fouling rate of said catalyst to exceed 0.3° C. per hour.

17. The process according to claim 16 wherein said recycled solids-lean stream contains ethyl acetate-insolubles in an amount insufficient to cause the fouling rate of said catalyst to exceed 0.05° C. per hour.

18. The process according to claim 17 wherein said coal is low-rank coal.

* * * * *

UNITED STATES PATENT AND TRADEMARK OFFICE

CERTIFICATE OF CORRECTION

PATENT NO. : 4,428,820

DATED : January 31, 1984

INVENTOR(S) : Christopher W. Kuehler et al

It is certified that error appears in the above-identified patent and that said Letters Patent are hereby corrected as shown below:

Col. 6, line 46, "shoul" should read --should--.

Col. 10, Table 1, "Dissolver", "Catalytic Reactor" should not be underscored.

Col. 11, Table 1, "Total $C_7$-Insolubles" should not be underscored.

Col. 11, Table 2, "Dissolver", "Catalytic Reactor" should not be underscored.

Col. 13, line 14, "400°" should read --400--.

Signed and Sealed this

Fourth Day of September 1984

[SEAL]

*Attest:*

GERALD J. MOSSINGHOFF

*Attesting Officer*

*Commissioner of Patents and Trademarks*